US007489890B2

(12) United States Patent
Fujisawa et al.

(10) Patent No.: US 7,489,890 B2
(45) Date of Patent: Feb. 10, 2009

(54) COLOR IMAGE FORMING APPARATUS WITH DIFFERING TONER TIME CONSTANTS

(75) Inventors: Toshiaki Fujisawa, Yamatokooriyama (JP); Takahiro Bitoh, Nara (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 134 days.

(21) Appl. No.: 11/581,357

(22) Filed: Oct. 17, 2006

(65) Prior Publication Data

US 2007/0098447 A1 May 3, 2007

(30) Foreign Application Priority Data

Oct. 31, 2005 (JP) ..... 2005-316239

(51) Int. Cl.
*G03G 15/01* (2006.01)

(52) U.S. Cl. ..... 399/223

(58) Field of Classification Search ..... 399/223, 399/231, 299

See application file for complete search history.

(56) References Cited

U.S. PATENT DOCUMENTS 5,223,668 A * 6/1993 Takaya et al. ..... 399/236
5,627,629 A 5/1997 Takahashi et al.
2005/0220489 A1* 10/2005 Furukawa ..... 399/149
2006/0002724 A1* 1/2006 Fujimori et al. ..... 399/27
2007/0292169 A1* 12/2007 Bitoh et al. ..... 399/298

FOREIGN PATENT DOCUMENTS

| | | |
|---|---|---|
| JP | 07-092762 | 4/1995 |
| JP | 08-106197 | 4/1996 |
| JP | 2003-043778 | 2/2003 |
| JP | 2005-134807 | 5/2005 |

* cited by examiner

*Primary Examiner*—Quana M Grainger
(74) *Attorney, Agent, or Firm*—Nixon & Vanderhye P.C.

(57) ABSTRACT

A color image forming apparatus includes: a multiple number of process printing units, each having a photoreceptor drum for forming a toner image with a toner corresponding to color-separated image information for each color and a developing unit for supplying the toner to the surface of the photoreceptor drum, wherein the toner images formed by electrophtography on the surfaces of the photoreceptor drums are transferred to a recording medium by the function of a transfer electric field, and is characterized in that the toners to be supplied to the photoreceptor drums from the developing units for every color are specified so that the time constants τ of the toners become greater as the position of toner supply is located more upstream in the development process.

6 Claims, 2 Drawing Sheets

FIG.2

Toner's time constants τ

| | Y | M | C | BK |
|---|---|---|---|---|
| τ (m sec) | 1,100±500 | 900±500 | 700±400 | 650±300 |

COLOR IMAGE FORMING APPARATUS WITH DIFFERING TONER TIME CONSTANTS

This Nonprovisional application claims priority under 35 U.S.C. §119(a) on Patent Application No. 2005-316239 filed in Japan on 31 Oct. 2005, the entire contents of which are hereby incorporated by reference.

BACKGROUND OF THE INVENTION (1) Technical Field

The technical field relates to a color image forming apparatus and in particular relates to a color image forming apparatus that uses electrophotography, such as a copier, printer, facsimile machine or the like.

(2) Description of the Prior Art

Recently, image forming apparatuses for supporting high-speed printing jobs have been developed.

For example, in the field of image forming apparatuses, processing ability of the conventional high-speed printing used to indicate a printing operation for 40 to 60 sheets per minute in terms of the number of monochrome printing with standard paper (A4 short-edge feed) a few years ago. However, at present the processing speed has been enhanced to as high as 100 to 120 sheets per minutes.

In addition, under the present circumstances, color image forming apparatuses such as full-color copiers etc., are mainly used for monochrome printing. Therefore, improvement of printing efficiency has been made by increasing the printing speed for monochrome printing and other ways.

However, as the printing speed increases, lowering of the development performance as well as toner scattering is likely to occur. Further, since the machine is frequently used for monochrome printing, extension of the maintenance interval of cleaning scattered toner and stabilization of image quality of both the full-color and monochrome printing are the matters to be considered.

As the countermeasures against the toner scatter problem there have been some proposals of image forming apparatuses, including: for example, a configuration in which blocking members for blocking air flow are laid out between each color developing device and the adjacent process unit (see Japanese Patent Application Laid-open 2003-43778 (patent literature 1); and another configuration in which the electric resistivity of the monochrome toner is specified to be equal to or greater than $10^{14}$ Ω·cm so that electricity in the toner layer will not be attracted to the opposite charge near the photoreceptor surface, whereby the toner is prevented from moving toward the electrostatic latent image (Japanese Patent Application Laid-open Hei 07-92762 (patent literature 2)).

However, provision of the blocking members between each color developing device and adjacent process unit as in patent literature 1 not only needs more parts and higher cost but also gives rise to a problem that the apparatus is unsuited for miniaturization.

Further, when the electric resistivity of the monochrome toner is specified to be equal to or greater than $10^{14}$ Ω·cm so that the toner will not be attracted to the opposite charge near the photoreceptor surface as in patent literature 2, image degradation problems such as image density lowering, etc., are prone to occur when high-speed printing is executed.

SUMMARY

In on aspect, a color image forming apparatus is provided which is stable in both the full-color image quality and monochrome image quality even in high-speed printing by a simple configuration, without needing more parts.

A non-limiting embodiment of a color image forming apparatus is configured as follows:

A first embodiment of a color image forming apparatus includes: a plurality of image forming units, each having an electrostatic latent image bearer for supporting a developer image formed with a developer corresponding to color-separated image informauon for each color and a developing device for supplying the developer to the surface of the electrostatic latent image bearer, wherein the developer images formed by electrophotography on the surfaces of the electrostatic latent image bearers are transferred to a recording medium by the function of a transfer electric field, and is characterized in that the toners to be supplied to the electrostatic latent image bearers from the developing devices for every color are specified so that the time constants of the toners become greater as the position of toner supply is located more upstream in the development process.

One such development process includes the supplying of the developers containing toners for individual colors from the developing devices to the electrostatic latent image bearers.

Further, the toner's time constant is defined by a product R.C, where R(Ω) is the toner's resistance and C(F) is the toner's capacitance.

In sum, the toner's time constant $\tau$ is proportional to the toner's resistance R and capacitance (the amount of electricity) C, the toner's time constant $\tau$ becomes greater and the toner's electricity accumulation time becomes longer as the toner's resistance or capacitance component is greater. In contrast, as the toner's resistance or capacitance component is smaller, the toner's time constant $\tau$ becomes smaller and the toner's electricity accumulation time becomes shorter.

The color image forming apparatus according to a second embodiment is characterized in that, in addition to the first embodiment, a monochrome toner developing device for supplying monochrome toner is included as one of the developing devices, and the monochrome toner developing device is disposed on the most downstream side in the development process.

The color image forming apparatus according to a third embodiment is characterized in that, in addition to the above configuration, the time constant of the monochrome toner is less than or equal to the time constants of the toners for others colors.

According to the first embodiment, in the color image forming apparatus including: a plurality of the forming units, each having an electrostatic latent image bearer for supporting a developer image formed with a developer corresponding to color-separated image information for each color and a developing device for supplying the developer to the surface of the electrostatic latent image bearer, wherein the developer images formed by electrophotography on the surfaces of the electrostatic latent image bearers are transferred to a recording medium by the function of a transfer electric field, the toners to be supplied to the electrostatic latent image bearers from the developing devices for every color are specified so that the time constants of the toners become greater as the position of toner supply is located more upstream in the development process. Accordingly, the electricity accumulation time of the toner that takes a longer time from time at which the toner transfers to the transfer medium to time at which the toner is fixed, is made longer, so that the toner which has been supplied first will not scatter even in high-speed printing, thus making it possible to provide stable image quality.

Further, since it is possible to achieve the above effect without the need of a adding any special component to the color image forming apparatus, it is possible to deal with miniaturization of the apparatus with a simple configuration without the necessity of more parts and increase cost.

Further, in addition to the above common effect, the second and third embodiments have the following effect.

Detailedly, according to the second embodiment, a monochrome toner developing device for supplying monochrome toner is included as one of the developing devices, and the monochrome toner developing device is disposed on the most downstream side in the development process. Accordingly, it is possible to shorten the time from time at which the toner transfers to the transfer medium to time at which the toner is fixed when monochrome printing is implemented, it is hence possible to provide an apparatus that can deal high speed printing.

According to the third embodiment, specifying the time constant of the monochrome toner to be less than or equal to the time constants of the toners for other colors, enable the monochrome toner to easily transfer to the transfer medium, hence it is possible to suppress image degradation such as image density lowering and background fogging in high-speed printing and improve the image quality.

BRIEF DESCRIPTION OF THE DRAWINGS

FIG. 2 is a table showing one example of time constant $\tau$ of the toner used for the color image forming apparatus.

DESCRIPTION OF THE PREFERRED EMBODIMENTS

Figure 1:
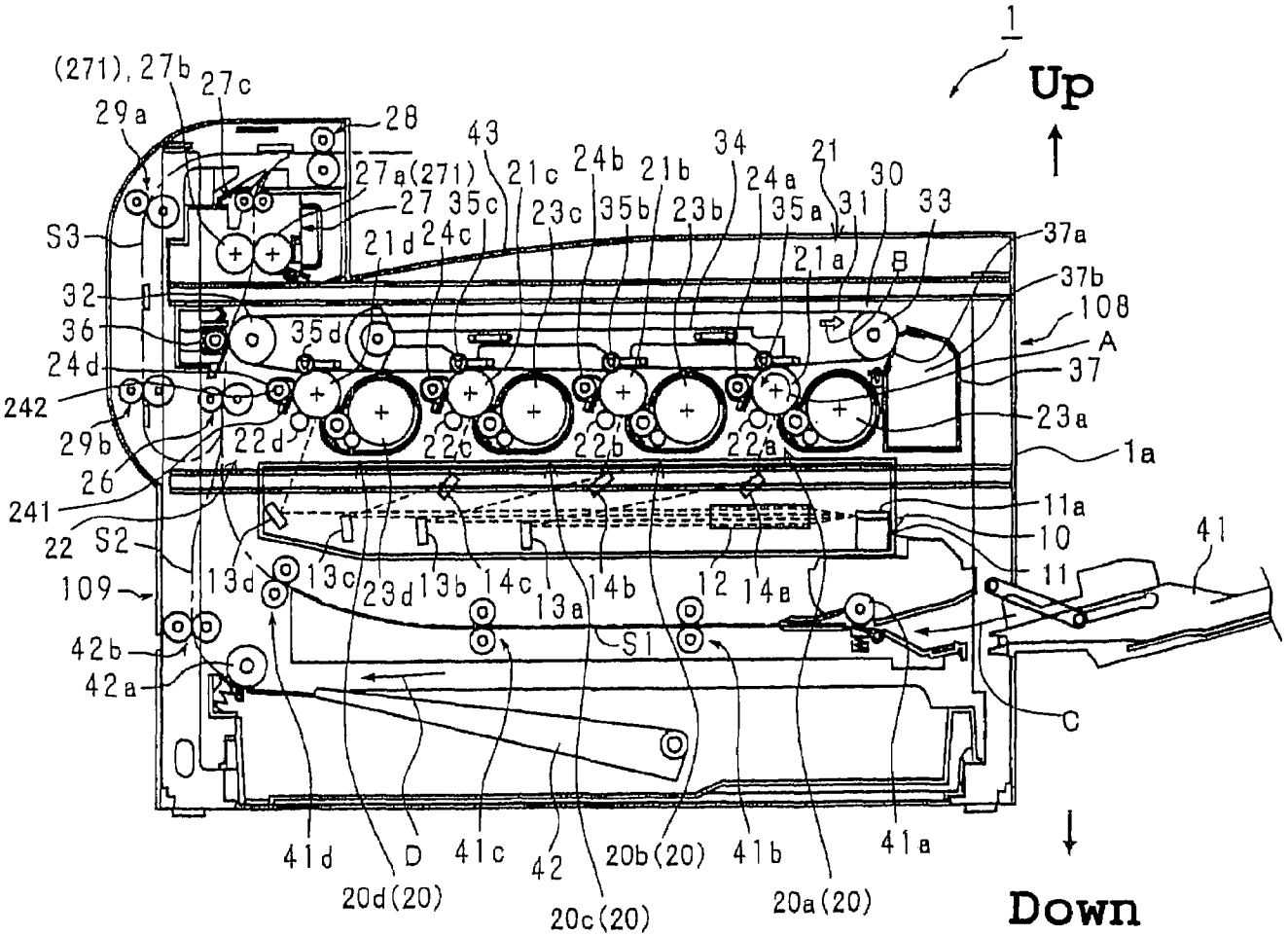
FIG. 1 is an illustrative diagram showing an overall configuration of a color image forming apparatus according to one embodiment.

The best mode for carrying out the present invention will hereinafter be described with reference to the drawings.

FIG. 1 shows a non-limiting example, and is an illustrative diagram showing an overall configuration of a color image forming apparatus.

As showing in FIG. 1, a color image apparatus 1 includes: a plurality of image forming means or namely, process printing units (developing means) 20 (20*a*, 20*b*, 20*c* and 20*d*) _each having a photoreceptor drum (electrostatic latent image bearer) 21 (21*a*, 21*b*, 21*c* or 21*d*) for supporting a developer image (which will refereed to as "toner image" hereinbelow) formed with a developer (which will be referers to as "toner" hereinbelow) corresponding to the color of color-separated image information; an exposure unit (light scanner) 10 for creating electrostatic latent images on photoreceptor drums 21 of individual colors by illumination of laser beams in accordance with image information; an endless transfer belt 31 constituting a transfer means to which a multiple number of toner images are transferred in layers; a transfer roller 36 as a constituent of a transfer means for transferring the toner images that have been transferred in layers on the transfer belt 31 all at once, to a recording sheet; and affixing 27 for thermally fixing the toner image that has been transferred to the recording paper, by means of a heart roller 27*a* and pressing roller 27*b*.

To begin with, the overall configuration of color image forming apparatus 1 will be described.

As shown in FIG. 1, color image forming apparatus 1 according to the present embodiment which can be a digital color printer adapted to putout a color image by separating color image information into images of individual colors, is mainly composed of an image forming portion 108 and a paper feed portion 109, and forms multi-color images or monochrome images on recording papers in accordance with a print job sent from an information processor (not illustrated) such as a personal computer etc., externally connected.

Image forming portion 108 forms multi-color images based on electrophotography with yellow (Y), magenta (M), cyan (C) and black (K) colors. This image forming portion 108 is mainly composed of an exposure unit 10, process printing units 20, fixing unit 27, a transfer belt unit 30 having transfer belt as a transfer means, transfer roller 36 an a transfer belt cleaning unit 37.

Describing the overall arrangement of image forming portion 108, fixing unit 27 is disposed on the top at one end side of a housing la of color image forming apparatus 1, transfer belt unit 30 is extended under the fixing unit 27 from the one end side to the other end side of housing 1*a*, process printing units 20 are disposed under the transfer belt unit 30, and exposure unit 10 is disposed under the process printing units 20.

Further belt cleaning unit 37 is arranged on the other end side of transfer belt unit 30. Also, a paper output tray 43 is arranged contiguous to fixing unit 27, over image forming portion 108. The paper feed portion 109 is arranged under the image forming portion 108.

In the present embodiment, as process printing units 20, four process printing units 20*a*, 20*b*, 20*c* and 20*d*, corresponding to individual colors, i.e., yellow (Y), magenta (M), cyan (C) and black (K), are arranged in the order mentioned along transfer belt 31.

The process printing unit 20*d* for the color whose toner image, among all the toner images to be transferred to transfer belt 31, is transferred to transfer belt 31 last, or in other words, the process printing unit 20*d* which is located at a position closest to transfer roller 36, holds a toner of black color so as to form a black toner image last on transfer belt 31.

These process printing units 20*a*, 20*b*, 20*c* and 20*d* are arranged in parallel to each other, in the approximately horizontal direction (in the left-to-right direction in the drawing) in housing la, and include respective photoreceptor drums 21*a*, 21*b*, 21*c* and 21*d* as the image support for each individual associated color, respective chargers 22*a*, 22*b*, 22*c* and 22*d* for charging the photoreceptor drums 21*a*, 21*b*, 21*c* and 21*d*, respective developing units (developing devices) 23*a*, 23*b*, 23*c* and 23*d* and respective cleaner units 24*a*, 24*b*, 24*c* and 24*d* and other components.

Here, the symbol a, b, c, and d are added to the constituents for each color so as to show correspondence to yellow (Y), magenta (M), cyan (C) and black (K), respectively. In the description hereinbelow, however, the constituents provided for each color are generally referred to as photoreceptor drum 21, charger 22, developing unit 23, and cleaner unit 24, except in the case where the constituent corresponding to the specific color needs to be specified.

The photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum 21. As charger 22, a roller type charger can be used and arranged, at a position on the approximately opposite side across photoreceptor drum 21, from transfer belt unit 30, and in contact with the outer peripheral surface of photoreceptor drum 21. Though in the present embodiment a roller type charger is used as charger 22, other charger types such as a fur-brush type charger, magnetic brush type charger, corona wire discharging type charger, saw-toothed charger, ion generation charging device etc., may be used as long as it can provide the necessary charging performance.

Each developing unit 23 holds a toner of yellow (Y), magenta (M), cyan (C) or black (K) color and is arranged on the downstream side of charger 22 with respect to the rotational direction of the photoreceptor drum (in the direction of arrow A in the drawing), so that the toner of each color is supplied to the electrostatic latent image formed on the peripheral surface of the photoreceptor drum 21 to produce a visual image.

Now, the toner of developing unit 23 in the present embodiment will be specifically described.

In the present embodiment, the color toners in developing units 23*a* to 23*d* are specified so as to have a greater time constant τ as they are supplied on the more upstream side in the development process.

More explicitly, the yellow (Y) toner that is transferred to transfer belt 31 first in the development process is specified to have the greatest time constant τ, and the time constants τ of the magenta (M) toner, cyan (C) toner and black (K) toner are specified to become smaller in this order.

Next, the time constant τ of toner will be described.

In general, the toner used in the image forming apparatus is a dielectric material, so that it has the resistance component and the capacitance (capacitor) component. Here, when the resistance of the toner is represented as R(Ω) and the capacitance of the toner as C(F), a state where a voltage is applied to the toner may be regarded as a series circuit of the resistance R(Ω) and the capacitance C(F).

When a d.c. voltage E(V) is applied to this series circuit, the moment at which voltage E is applied is set at time=0 and the current that flows through the circuit at time t is represented by i(t) (A) and the amount of electricity stored in the capacitor is represented by q(t) (C: coulomb). With this, the circuit can be expressed by the following equation:

$$E=R\cdot i(t)+q(t)/C \qquad \text{Eq. (1).}$$

Here, the current is a flow of electrons, or the rate of change of electricity, hence can be written as $$i(t)=dq(t)/dt.$$

As this is substituted into Eq. (1), the following differential equation as to the amount of electricity q(t) can be obtained.

$$E=[(R\cdot dq(t)/dt)+qt]/C \qquad \text{Eq. (2).}$$

Solving this Eq. (2), q(t) can be represented as an exponential function of t as follows.

$$q(t)=CE(1-\exp(-t/RC)) \qquad \text{Eq. (3).}$$

In addition, when the voltage between the ends of the capacitor is assumed to be ec(t), q(t)=C·ec(t), hence the following relationship can be obtained:

$$ec(t)=E(1-\exp(-t/\tau)) \qquad \text{Eq. (4).}$$

where τ=RC.

Here, the product of R and C is the time constant τ of the circuit.

Accordingly, when the resistance of the toner is represented as R, and the capacitance of the toner is represented as C, the product RC is defined as the time constant τ of the toner. According to Eq. (4), as τ is greater, it takes longer time for ec(t) to become the maximum value E. Since the time constant τ is proportional to the toner's resistance R and capacitance (the amount of electricity) C, the toner's electricity accumulation time becomes longer as the toner's resistance or capacitance component is greater.

In order to determine the time constant τ, an a.c. rectangular wave in addition to on/off of a d.c. power source is applied to the circuit.

In practice, a dielectric loss measuring device (trade name: TRS-10T, a product of Ando Electric Co., Ltd.) was used to measure the resistance (R) and capacitance (C) of the toner and determine the time constant τ.

Here, as an example, the toners are specified to have the following time constants τ, as shown in FIG. 2.

Yellow (Y) toner: 1,100±500 (msec)
Magenta (M) toner: 900±500 (msec)
Cyan (C) toner: 700±400 (msec)
Black (K) toner: 650±300 (msec)

Cleaner unit 24 is arranged on the upstream side of charger 22 with respect to the rotational direction of the photoreceptor drum 21. The cleaner unit 24 has a cleaning blade 241 and is configured so that the cleaning blade 241 is positioned an abutment with the outer peripheral surface of photoreceptor drum 21 so as to scrape and collect the leftover toner off the photoreceptor drum 21. A reference numeral 242 in the drawing designates a conveying screw for conveying the collected toner. In the present embodiment, cleaning blade 241 and conveying screw 242 for conveying the collected toner are used, but the cleaning unit 24 is not limited to this configuration. One or more cleaning blades may be used or a fur-brush or magnetic brush may be used alone. Alternatively, the fur-brush or magnetic brush may be used in combination with the cleaning blade. That is, any configuration may be used as long as it can scrape and collect the leftover toner off the photoreceptor drum 21.

The exposure unit 10 is mainly composed of a box-shaped housing 1O*a*, a laser scanning unit (LSU) 11 having a laser illuminator 11 *a* incorporated in the housing, a polygon mirror 12 and reflection mirrors 13*a*, 13*b*, 13*c*, 13*d*, 14*a*, 14*b* and 14*c* for reflecting the laser beam for different colors.

The laser beam emitted from laser illuminator 11 a of laser scanning unit 11 is separated into components for different colors, by a polygon mirror 12 and an unillustrated f-.theta. lens, then the separated components of light are reflected by the respective reflection minors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of laser illuminator 11*a*. Also, a light source in combination with a liquid crystal shutter may be used. That is, any configuration can be used as long as it can create an electrostatic latent image on the photoreceptor drum 21 surface.

Next, description will be made on the configuration of transfer belt unit 30.

As shown in FIG. 1, transfer belt unit 30 is mainly composed of transfer belt 31, a transfer belt drive roller 32, a transfer belt driven roller 33, a transfer belt tension mechanism 34 and intermediate transfer rollers 35*a*, 35*b*, 35*c* and 35*d*.

In the following description, any of the intermediate transfer rollers 35*a*, 35*b*, 35*c* and 35*d* will be referred to as intermediate transfer roller 35 when general mention is made.

The transfer belt 31 is formed of an endless film of about 75 μm to 120 μm thick. The transfer belt 31 is mainly made from polyimide, polycarbonate, thermoplastic elastomer alloy or the like, but are not limited to these materials.

Also, transfer belt 31 is tensioned by transfer belt drive roller 32, transfer belt driven roller 33, transfer belt tension mechanism 34 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

The transfer belt drive roller 32 is disposed at one end side of housing 1*a* and drives the transfer belt 31 by applying a driving force to the belt whilst nipping and pressing the transfer belt 31 and a recording sheet together between itself and transfer roller 36 to convey the recording sheet.

The transfer belt driven roller 33 is disposed on the other end side of housing 1*a*, so as to suspend and tension the transfer belt 31 approximately horizontally from the one end side to the other end side of housing 1*a*, in cooperation with transfer belt drive roller 32. However, if the dimension in the width direction of color image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from one end side to the other of housing l*a* while the photoreceptors, developing units, laser illuminator, fixing unit and other components may be rearranged and resized as appropriate in association with that displacement.

The intermediate transfer rollers 35 are arranged in the interior space of transfer belt 31 wound between transfer belt drive roller 32 and transfer belt driven roller 33 and positioned with their axes displaced, in the lateral direction in the drawing, to the downstream side with respect to the moving direction of transfer belt 31, so as to abut the inner surface of transfer belt 31 and press its outer peripheral surface against the outer peripheral surfaces of the photoreceptor drums 21, forming a predetermined amount of stainless steel) shaft having a diameter of S to 10 nun and a conductive elastic nip contact.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration is not limited to use of these elastic materials.

Each of the thus formed intermediate transfer rollers 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information input to the apparatus. The thus formed laminated image information is transferred to the recording sheet by transfer roller 36 disposed at the contact point of transfer belt 31 with the recording paper.

The transfer roller 36 as a constituent of the transfer means for transferring the toner image transferred to transfer belt 31 to recording paper, is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A pair of registration rollers 26 is provided under transfer belt drive roller 32 and transfer roller 36. This registration roller 26 is configured so as to set the front end of a recording sheet fed from paper feed portion 109 aligned with the leading end of the toner image on transfer belt 31 and deliver the sheet toward the transfer roller 36 side.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, transfer belt cleaning unit 37 is adapted to remove and collect such toner.

The transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the toner, left over on and scraped from transfer belt 31 (waste toner) by the cleaning blade 37*a*, to thereby serape and collect the leftover toner off the transfer belt 31 surface.

Also, transfer belt cleaning unit 37 is located near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Next, the configuration of fixing unit 27 will be described.

The fixing unit 27 includes: as shown in FIG. 1, a pair of fixing rollers 271 a including a heat roller 27*a* and a pressing roller 27*b*; and a pair of conveying rollers 27*c* above the fixing rollers 271. The recording sheet is input from below fixing rollers 271 and output to above conveying rollers 27*c*.

Above fixing unit 27, a pair of paper discharge rollers 28 is arranged adjacent to conveying rollers 27*c*, so that the recording sheet conveyed from conveying rollers 27*c* is discharged by the paper discharge rollers 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep the heat roller 27*a* at a predetermined temperature (fixing temperature) while the recording sheet with a toner image transferred thereon is heated and pressed between heat roller 27*a* and pressing roller 27*b* as it is being conveyed and rolled, so that the toner image is thermally fused onto the recording sheet.

A duplex printing paper path S3 for double-sided printing is constructed adjacent to fixing unit 27, from above fixing unit 27 downward to the vicinity of paper feed portion 109. A pair of conveying rollers 29*a* and a pair of conveying rollers 29*b* are arranged at the top and bottom, respectively and along the duplex printing paper path S3, thereby the recording sheet is delivered again toward transfer roller 36 with its face inverted.

Specifically, conveying rollers 29*a* are disposed on the left side of fixing unit 27 in FIG. 1 and conveying rollers 29*b* are located below conveying rollers 29*a* with respect to the top and bottom direction and at approximately the same level as registration roller 26. In the present embodiment, heat roller 27*a* using a heating means made up of a heater lamp etc., is used with pressing roller 27*b*, but an induction heating type heating means may be used alone or in combination. Further, it is not necessary to use the roller as a means for applying pressure. That is, any appropriate method can be used as long as it can fix the toner image with heat without causing any image disturbance.

Next, the configuration of paper feed portion 109 will be described.

The paper feed portion 109 includes a manual feed tray 41 and a paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of color image forming apparatus 1 so that it can be unfolded outside when used and folded up to the one end side when unused. This tray delivers paper, one by one, into the housing 1*a* of color image forming apparatus 1 when the user places a few recording sheets (necessary number of sheets) of a desired type.

Arranged on the downstream side with respect to the paper feed direction (the direction of arrow C in the drawing) of recording paper by manual feed tray 41, inside housing 1*a* of color image forming apparatus 1, is a pickup roller 41*a* below exposure unit 10. Conveying rollers 41*b*, 41*c* and 41*d* are also disposed at approximately the same level along the path downstream with respect to the paper feed direction.

The pickup roller 41 a touches one edge part of the surface of the recording sheet that is fed from manual feed tray 41 and reliably conveys the paper, sheet by sheet, by the function of roller's frictional resistance.

The conveying roller 41*d* located on the most downstream side is positioned above conveying rollers 41*b* and 41*c*, so as to convey the recording paper upward.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A pair of conveying rollers 42*b* are also provided obliquely above and on the downstream side of the pickup roller 42*a* with respect to the recording paper feed direction (the direction of arrow D in the drawing).

The pickup roller 42*a* touches one edge part of the surface of the topmost sheet of a stack of recording sheets set on paper feed cassette 42 and reliably picks up and feeds the paper, sheet by sheet, by the function of roller's frictional resistance.

The conveying 42*b* conveys the recording sheet delivered from pickup roller 42*a* upward along a recording sheet feed path S2 formed on one end side inside housing 1*a* to image forming portion 108.

Next, image output by color image forming apparatus 1 in the present embodiment will be described.

The color image forming apparatus 1 is constructed so as to transfer the toner images formed on photoreceptor drums 21 to a recording sheet fed from paper feed portion 109 by a so-called intermediate transfer process (offset process), or via transfer belt 31.

First, charging device 22 uniformly electrifies the outer peripheral surface of photoreceptor drum 21 at a predetermined voltage.

Each electrified photoreceptor drum 21 is irradiated with a laser beam from exposure unit 10, so that an electrostatic latent image for each color is formed on the photoreceptor drum 21 for the color.

Then, toners are supplied from developing units 23 to the outer peripheral surfaces of photoreceptor drums 21*a* to 21*d* so that the static latent images formed on the outer peripheral surface of photoreceptor drums 21 are visualized with toners so as to form toner images.

The toner images formed on photoreceptor drums 21*a* to 21*d* are transferred to transfer belt 31. Transfer of the toner image from photoreceptor drum 21 to transfer belt 31 is done by intermediate transfer roller 35 arranged in contact with the interior side of transfer belt 31 by application of a high voltage.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge, on photoreceptor drum 21 is transferred to transfer belt 31 as the photoreceptor drum 21 turns and comes into contact with transfer belt 31.

The toner images of colors formed on respective photoreceptor drums 21*a* to 21*d* are transferred to transfer belt 31 as photoreceptor drums 21*a* to 21*d* turn and come into contact with the moving transfer belt 31, and overlaid one over another, in the order of yellow (Y), magenta (M), cyan (C) and black (K), thus a color toner image is formed on transfer belt 31.

In this way, the toner images developed from static latent images on photoreceptor drums 21*a* to 21*d* for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image on transfer belt 31 is transferred from transfer belt 31 to the recording sheet by the function of transfer roller 36.

Since the toner adhering to transfer belt 31 as the belt comes in contact with the leftover toner on photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When the recording paper placed on manual feed tray 41 is used, the paper is taken in by pickup roller 41*a* from manual feed tray 41, sheet by sheet, at controlled timings in accordance with the instructions from the control panel (not shown), and fed into the machine.

The recording sheet thus taken into the machine is conveyed along recording paper feed path S1 by conveying rollers 41*b*, 41*c* and 41*d* to image forming portion 108.

When the recording paper accommodated in paper feed cassette 42 is used, the paper is separated and fed from paper feed cassette 42, sheet by sheet, by pickup roller 42*a*, and conveyed by conveying roller 42*b* along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with the toner image transferred thereon is further conveyed approximately vertically and reaches fixing unit 27, where the toner image is thermally fixed to the recording sheet by heat roller 27*a* and pressing roller 27*b*.

The recording sheet having passed through fixing unit 27 is discharged by discharge rollers 28 when one-sided printing is selected, and placed face down on paper output tray 43.

In contrast, when double-sided printing is selected, the recording sheet is stopped and nipped by paper discharge rollers 28, then the paper discharge rollers 28 are rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge rollers 28.

Thus, the output operation is performed by transferring toner images onto recording paper.

According to the present embodiment configured as described above, the time constants τ of the toners supplied from developing units 23*a* to 23*d* are specified to become smaller from the maximum value in the order of yellow (Y), magenta (M), cyan (C) and black (K). That is, since the electricity accumulation time of the yellow (Y) which is located most distant from transfer roller 36 is specified to be longest while the electricity accumulation time of the black (K) which is located closest from transfer roller 36 is specified to be shortest, no toner scattering of yellow (Y) and magenta (M) toners which are supplied first will occur even in the case of high-speed printing. It is therefore possible to achieve stable transfer of the toner without causing any toner image disturbance, and provide fair image quality.

Thus, in accordance with the color image forming apparatus 1 of the present embodiment, since toner scattering can be reduced, it is possible to operate the apparatus continuously over a long period of time without the necessity of maintenance against toner scattering.

Further, in accordance with the present embodiment, developing unit 23*d* for black (K) is disposed at a position closest to transfer roller 36 and the time constant τ of the black (K) toner is specified to be small, so that it is possible to shorten the time for the toner from time at which the toner transfers from photoreceptor drum 21*d* to transfer belt 31 to time at which the toner is transferred to the recording paper by transfer roller 36. Accordingly, it is possible also in the case of high-speed monochrome printing to suppress image degradation such as low image density, blurred characters and the like, hence provide good image quality.

The recording sheet with the toner image transferred thereon is further conveyed approximately vertically and reaches fixing unit 27, where the toner image is thermally fixed to the recording sheet by heat roller 27*a* and pressing roller 27*b*.

In the present embodiment, as the configuration of color image forming apparatus 1, process printing units 20*a* to 20*d* for multiple colors each having a photoreceptor drum, are provided to form a color image. However, the embodiments are not limited to the image forming configurations including photoreceptor drums and developing units, and can apply to an image forming apparatus using electrophotography such as a model in which toners for multiple colors are supplied to a single photoreceptor drum, a two-photoreceptor drum model, an endless belt type photoreceptor model and others as long as it essentially makes use of difference in transfer performance and separation performance between the toners by differentiating the time constants τ of the toners.

Further, in the present embodiment, the time constants T of the yellow (Y), magenta (M), cyan (C) and black (K) toners are specified to be the values shown in FIG. 2. However, the time constants τ not limited to these values in the embodiment, and the time constants of the toners can be specified appropriately, depending on the toner and developer composition characteristics and the apparatus configuration, or depending on the type of toner, such as non-magnetic mono-component toner, combined use of non-magnetic mono-component toner and magnetic mono-component toner, insulative toner, conductive toner, and others.

What is claimed is:

1. A color image forming apparatus, comprising:

a plurality of image forming units, each including:

an electrostatic latent image bearer for supporting a developer image formed with a toner corresponding to color-separated image information for each color, and a developing device for supplying the toner to the surface of the electrostatic latent image bearer, wherein the developer images formed by electrophotography on surfaces of the electrostatic latent image bearers are transferred to a recording medium by a function of a transfer electric field, and wherein the toners to be supplied to the electrostatic latent image bearers from the developing devices for every color are specified so that time constants of the toners become greater as the position of the developing device is located more upstream in a development process.

2. The color image forming apparatus according to claim 1, wherein a monochrome toner developing device for supplying a monochrome toner is included as one of the developing devices, and the monochrome toner developing device is disposed on the most downstream side in the development process.

3. The color image forming apparatus according to claim 2, wherein the time constant of the monochrome toner is less than or equal to the time constants of the toners for other colors.

4. The color image forming apparatus according to claim 1, wherein the time constant of each toner is defined as RC where R is a resistance of the toner and C is a capacitance of the toner.

5. The color image forming apparatus according to claim 1, further comprising:

a transfer belt arranged to receive image color from individual electrostatic latent image bearer of each image forming unit and to transfer a total image to the recording medium.

6. The color image forming apparatus according to claim 1, wherein the plurality of image forming units include a yellow image forming unit, a magenta image forming unit, a cyan image forming unit and a black image forming unit, and wherein the time constants of yellow, magenta, cyan and black toners are respectively 1100±500 msec, 900±500 msec, 700±400 msec and 650±300 msec.

* * * * *